US006338447B1

(12) United States Patent
Stanier et al.

(10) Patent No.: US 6,338,447 B1
(45) Date of Patent: Jan. 15, 2002

(54) DEVICE FOR TENSIONING YARN OR THE LIKE

(75) Inventors: John George Stanier, Ross-on-Wye; Robert Graham Harris, Longlevens; Nicholas John Stanier, Ross-on-Wye, all of (GB)

(73) Assignee: New House Textiles Limited, Herefordshire (GB)

( * ) Notice: Subject to any disclaimer, the term of this patent is extended or adjusted under 35 U.S.C. 154(b) by 0 days.

(21) Appl. No.: 09/512,679

(22) Filed: Feb. 25, 2000

(30) Foreign Application Priority Data

Feb. 26, 1999 (GB) ..... 9904458

(51) Int. Cl.[7] ..... B65H 59/18; B65H 51/02; H02K 1/22

(52) U.S. Cl. ..... 242/155 M; 242/365.7; 242/419.9; 310/261; 310/266; 318/6

(58) Field of Search ..... 242/147 M, 155 M, 242/155 BM, 365.7, 419.9; 318/6, 7; 226/39; 310/261, 266

(56) References Cited

U.S. PATENT DOCUMENTS 2,519,882 A * 8/1950 Bullard et al. ..... 242/155 M X
3,797,775 A * 3/1974 White ..... 242/155 M
4,673,139 A * 6/1987 Memminger et al. .... 242/365.7
5,080,295 A * 1/1992 Hongo et al. ..... 242/155 M X
5,234,177 A * 8/1993 Maji et al. ..... 242/422.2 X
5,423,197 A * 6/1995 Roser ..... 242/365.7 X
5,826,774 A 10/1998 Dell'Aglio et al.
5,873,436 A * 2/1999 Schneider

FOREIGN PATENT DOCUMENTS

DE 298 00 648 6/1999
GB 721643 1/1955

OTHER PUBLICATIONS

Japanese Patent Abstract JP 9140119A May, 1997.*

* cited by examiner

*Primary Examiner*—Michael R. Mansen
(74) *Attorney, Agent, or Firm*—Young & Thompson

(57) ABSTRACT

A device for applying tension to yarn or the like, the device including a stator and a rotor. The rotor includes an outer spool around which, in use, yarn or the like is passed and an inner part including a cylindrical sleeve-like portion. The stator includes outer pole piece defining apparatus extending between the outer spool and the sleeve-like portion of the inner rotor part, inner pole piece defining apparatus surrounded by the sleeve-like portion of the inner rotor part and apparatus for producing a magnetic flux between the inner and outer pole piece defining apparatus.

8 Claims, 1 Drawing Sheet

DEVICE FOR TENSIONING YARN OR THE LIKE

This invention relates to a device for tensioning yarn or the like and more particularly but not necessarily exclusively to a device for applying tension to individual yarns and the like during warping or direct yarn feed processes (and in other textile, or related activities), so that the applied tension can be automatically adjusted over a wide tension range, and to maintain a constant and uniform tension with the minimum of yarn damage, thereby improving woven or knitted fabric quality, reduce fault rates, and allow the machine to operate at higher speeds than otherwise achievable.

Wire is often braided by a weaving type of operation, or prepared, or fed into machines, and the term yarn as used herein is intended to also cover wire.

A "warper" is a machine for preparing yarns ready for weaving by winding hundreds (sometimes thousands) of parallel yarns from individual bobbins onto a spool known as a beam or a warp beam. This beam forms the warp in weaving or warp knitting. In some instances, the yarns can be warped directly into the textile machine.

The bobbins are held in an ordered fashion on a large frame known as a creel and drawn through a tension unit (located as close as practicable to the bobbins) to add sufficient tension to allow the yarn to be kept under control. Creels can sometimes be 20 to 30 meters in length in order to accommodate large numbers of bobbins.

A long standing problem in the textile industry has been the control of yarn tension during these processes, and many types of tension units have accordingly been developed to maintain a constant and consistent tension in each yarn across the warp. In the past various mechanical arrangements have been introduced, and more recently, variable drag spools have been designed, based on using the yarn feed as the driving means for a small electric generator, usually a small motor. Yarn from the bobbin is trained around the periphery of the rotatable spool or capstan, and in response to the travel of this yarn, is made to rotate. The drag rate of the spool is varied by varying the electrical load on the generator, which in turn, increases/decreases the tension on the outgoing yarn.

Conventional rotors, however, make relatively heavy spools, being constructed from iron laminations to improve the operational efficiency.

Ideally, any spool in the path of the yarn should have a minimum mass, since high movements of inertia cause over tensions at start-up, overruns when stopping, and a poor frequency response to control signal changes.

SUMMARY OF THE INVENTION

According to one aspect of the present invention there is provided a device for applying tension to yarn or the like, comprising a stator and a rotor, wherein the rotor comprises an outer spool around which, in use, yarn or the like is passed and an inner part including a cylindrical sleeve-like portion and wherein the stator comprises outer pole piece defining means extending between the outer spool and the sleeve-like portion of the inner rotor part, inner pole piece defining means surrounded by the sleeve-like portion of the inner rotor part and means for producing a magnetic flux between the inner and outer pole piece defining means, the rotor being formed of or substantially formed of aluminium or an aluminium alloy.

Preferably, the magnetic flux producing means comprises one or more coils.

Such a device produces a torque resulting entirely from the generation of an eddy current circulating within the inner rotor part. In practice the yarn or the like is wound around the outer spool so that the magnetic flux applies a reaction torque to the yarn. If the coil means produces a rotating magnetic flux, the yarn or the like will be in tension even when the rotor is stationary. The lightweight aluminium or aluminium alloy rotor provides low inertia. The reaction torque applied to the yarn or the like can be varied by varying the current applied to the one or more coils.

Preferably, the inner rotor part is connected at one end to the outer spool and has at another end a radially inwardly extending flange which supports an outer race of a ball or roller bearing assembly. In this case, the inner rotor part may have at said one end a radially outwardly extending flange connected directly or indirectly to the outer spool.

Preferably, the one or more coils are mounted on a core which includes a plurality of radially outwardly extending coil mounting parts equal in number to a number of said coils. In this case, the outer pole piece defining means comprises a plurality of pole pieces equal in number to the number of coils and the outer pole pieces are connected to respective coil mounting parts of the core.

According to a second aspect of the invention there is provided a device for applying tension to yarn or the like, the device comprising a stator, a rotor and a transducer for sensing a tension in the yarn, wherein the rotor comprises an outer spool around which, in use, yarn or the like is passed and an inner part including a cylindrical sleeve-like portion, and wherein the stator comprises outer pole piece defining means extending between the outer spool and the sleeve-like portion of the inner rotor part, inner pole piece defining means surrounded by the sleeve-like portion of the inner rotor part and means for producing a magnetic flux between the inner and outer pole piece defining means, the rotor being formed of or substantially formed of aluminium or an aluminium alloy.

Preferably, the device further comprises comparator means for comparing the tension sensed by the transducer with a reference value and for varying a current applied to the magnetic flux producing means in response to a difference between the sensed tension and the reference value to maintain a tension in the yarn equal to said reference value.

The invention will now be more particularly described by way of example, with reference to the accompanying drawings.

DESCRIPTION OF THE PREFERRED EMBODIMENT

Figure 1:
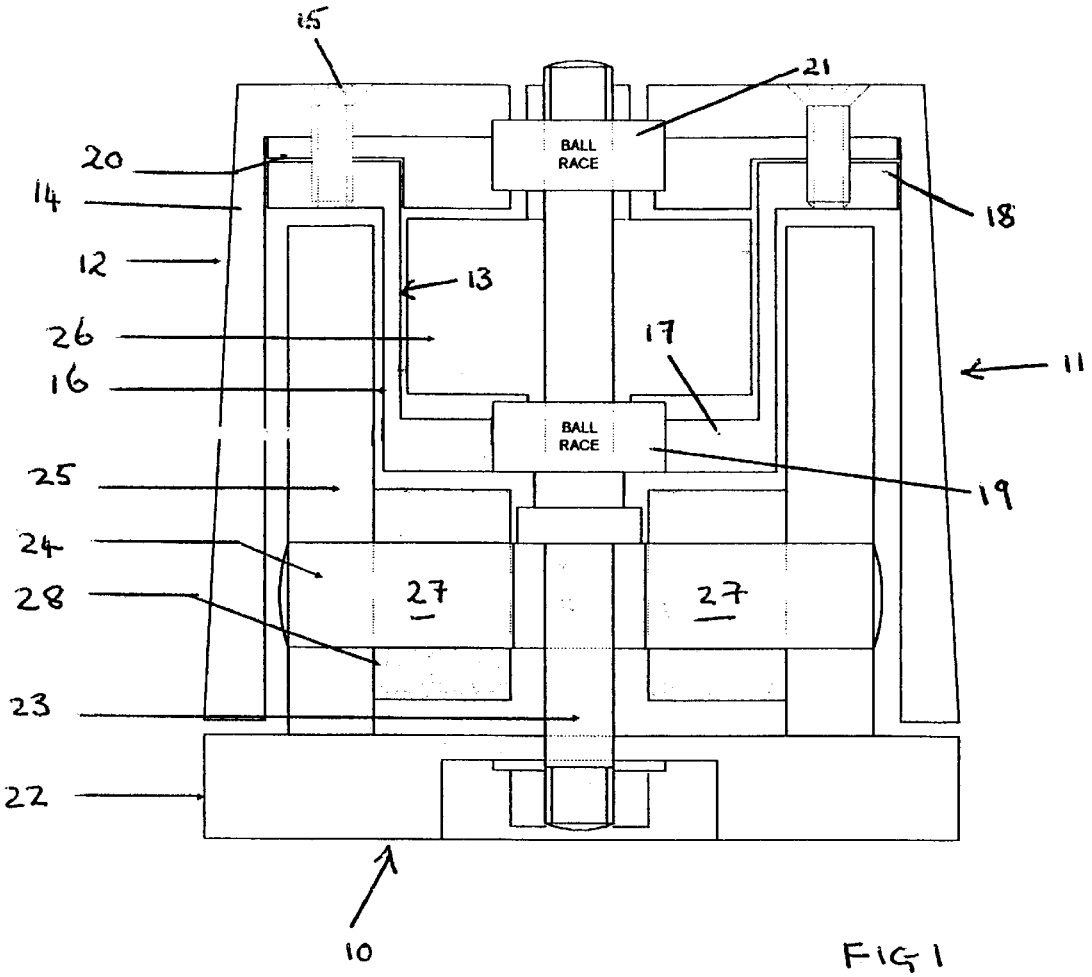
FIG. 1 is a schematic view of one embodiment of a device according to the first aspect of the present invention.

Referring firstly to FIG. 1 of the drawings, the device shown therein comprises a stator 10 and a rotor 11.

The rotor 11 comprises an outer spool 12 around which yarn is passed en route to a textile machine, and an inner part 13. The outer spool 12 has a skirt portion 14 and a radially inwardly extending flange 15 at the upper end of the skirt portion 14. The inner part 13 comprises a cylindrical sleeve-like portion 16 having a radially inwardly extending flange 17 at its lower end and a radially outwardly extending flange 18 at its upper end. The radially inwardly extending flange 17 supports the outer race of a ball or roller bearing assembly 19 and the radially outwardly extending flange 18 is connected to the radially inwardly extending flange 15 of the outer spool 12 with a sandwich plate 20 interposed between them. The radially inwardly extending flange 15 of the outer spool 12 and the sandwich plate 20 support the outer race of a second ball or roller bearing assembly 21. The outer spool 12, the inner spool 13 and the sandwich plate 20 are all made of aluminium or an aluminium alloy.

The stator 10 comprises a base 22, a spindle 23 secured to and upstanding from the centre of the base 22, a core 24 mounted on the spindle 23, arcuate outer pole pieces 25 and an inner pole piece 26. The spindle 23 also supports the inner races of the ball or roller bearing assemblies 19 and 21.

The inner pole piece 26 is mounted on the spindle 23 between the two bearing assemblies 19 and 21 and is surrounded by the sleeve-like portion 16 of the inner part 13 of the rotor 11.

The core 24 has four radially outwardly extending coil mounting parts 27 to the outer end of each of which is connected an outer pole piece 25. The coil mounting parts 27 support two pairs of coils 28 which are spaced apart by 90° relative to one another. More than two pairs of coils 28 and a corresponding number of coil mounting parts 27 could, however, be provided.

The core 24 and the coils 28 are mounted below the inner part 13 of the rotor 11, but the outer pole pieces 25 extend between the skirt portion 14 of the outer spool 12 and the sleeve-like portion 16 of the inner part 13 of the rotor 11.

The inner and outer pole pieces 26 and 25, respectively, are typically formed of soft magnetic iron.

The sleeve-like portion 16 of the inner part 13 of the rotor 11 thus lies in the path of a magnetic circuit formed by the coils 28, the core 24, the outer pole pieces 25 and the inner pole piece 26.

In use, alternating voltage supplies are connected to each of the coil pairs such that the supply to each of the coils 28 is phase displaced by 90°. This arrangement sets up a rotating magnetic flux between the outer pole pieces 25 and the inner pole piece 26. This flux rotates at the supply frequency so that a 50 Hz supply rotates the flux at 1500 rpm.

This rotating flux passes through the sleeve-like portion 16 of the inner rotor part 13 creating a reaction torque even when the rotor 11 is stationary. When the rotor 11 rotates under the influence of the yarn, the direction of mechanical rotation is opposite to that of the magnetic flux, so that the relative speed of rotor 11 and flux further increases, with a corresponding increase in torque.

Basically, the device operates as an inefficient motor due to the relatively large air gap. The available torque is therefore limited to suitable tensioning values (typically 200 g) and the lightweight aluminium (or aluminium alloy) rotor provides low inertia, these being ideal characteristics for this particular application.

If the magnetic flux density across the inner rotor air gap has a value B, then the induced e.m.f. in the rotor Er Blv volts, where l is the length of inner rotor normal to the magnetic field, and v is the peripheral velocity of the rotor relative to the magnetic flux.

This induced e.m.f. occurs on both sides of the inner rotor and act together in series to circulate an eddy current Ir around this rotor circuit.

This has a value of 2Er/R where R is the value of the rotor resistance.

In turn, this induced current imposes a torque T at the surface of the rotor, proportional to BIrl so that T $B^2l^2v/R$.

In practice, the peripheral velocity of the rotor relative to the flux is due to the sum of the following two components:

1. The frequency of the supply which causes rotation of a magnetic flux, even when the spool is stationary.
2. The linear speed of the yarn, which is virtually constant during normal operation, since the yarn is drawn off the package at a fixed rate.

The resultant torque T is proportional to $B^2$ and the combined speeds of these two effects.

Since flux density B is proportional to the excitation current in the coils 28, the drag torque (tension) imparted to the yarn can be directly controlled by varying the coil excitation current.

The fact that the tension can be controlled on a stationary spool means that the correct tension can be set and held at all stages of the process. This is particularly important to maintain consistency in the warp beam, even during setting and start-up operations.

Figure 2:
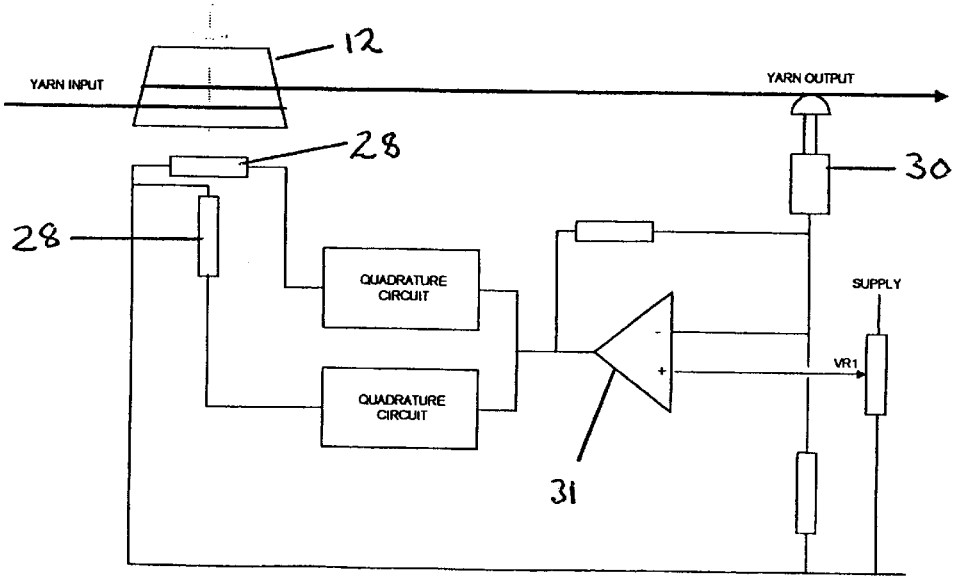
FIG. 2 is an electric circuit diagram showing the device of FIG. 1 in combination with a transducer for sensing the tension in the yarn.

FIG. 2 of the drawings shows a closed loop tensioning system including the device shown in FIG. 1. The required feed tension is pre-set as a reference value in potentiometer VR1. A tension transducer 30 senses the tension in the yarn. This transducer can be of any appropriate form. Typical transducers for measuring yarn tension are described in British Patent Application No. 9727151.4. A comparator 31 compares the yarn tension sensed by the transducer 30 with the pre-set reference value. If the output tension falls, indicated by the tension transducer 30, the spool excitation current is increased, increasing the drag which restores the tension to the reference value. If the output tension increases, the excitation is reduced, reducing the drag to the reference value.

A device as described above has the following advantages over known yarn tensioning devices:

1. The resultant torque due to the rotating field and rotation of the rotor provides almost twice the range of torque values compared to an equivalent direct current device. This is particularly important to deal with a wider variety of yarns.
2. The higher range of torque allows much higher running speeds on the heavier yarns which in some cases can double productivity.
3. The rotating magnetic field produces a controllable torque even when the spool is stationary. This ensures consistency of yarn tension from zero to full speed. Direct current devices can only produce torque which is proportional to the speed of the spool, and produce therefore zero torque at zero speed.
4. The design has improved breaking characteristics, since the breaking effect of the rotating field remains constant down to zero speed so that the risk of overruns under breaking conditions are minimised.
5. The combination of the aluminium rotor design with a wide torque range, from zero to full speed, enables a rapid response to any sensed change in tension.
6. The circuitry which conditions the tension transducer signal, provides the critical dampening for stable operations of the control loop. In mechanically controlled tensioners, oil filled dashpots and other devices are employed which exhibit overdamped and temperature dependant operating characteristics which can present ongoing maintenance, and other problems.
7. The warping machines which draw the yarns from the tensioner spools, have traditionally been fitted with speed control devices which attempt to maintain the linear yarn speed at a constant value. This means that as the warping beam fills with yarn the outside diameter of the yarn increases and the rotational speed of the roller is progressively decreased to compensate. The whole purpose of this exercise is to maintain a constant speed for the traditional tensioner devices, since any variation in speed causes subsequent variations in tension imparted into the yarns. Use of the closed loop system outlined above, maintains a constant tension which is largely independent of the speed of the warping machine. The control of the beam winder could therefore be simplified.

8. Higher levels of torque are available and this permits the use of a large diameter spool, which in turn reduces mechanical stress placed on the yarn to help enable it preserve its structural integrity, and thus reduce fly (the term given to the fibres and small particles of yarn that break off during processing). This can be of particular importance where delicate yarns are to be processed with the minimum of damage, or with fibres such as cotton, where health and safety issues can arise with a high level of fly.
9. Often the upper limit of the speed at which a beam winder can operate is dictated by the breaking point of the yarns. Studies have shown that the distribution of tensions within the individual yarns on a creel can be widely distributed, and that the yarns breaking the most readily are those under the greatest tension. The above tensioning device is eminently suitable for use in conjunction with a yarn-tension measuring device due to its electrical nature and fast response time. Therefore, the distribution of tensions can be narrowed, allowing the beam winder to be run at significantly higher speeds with less yarn breakage, less downtime, a more evenly tensioned warp, and once woven or knitted, an improved quality of fabric.

The above embodiment is given by way of example only and various modifications may be made without departing from the spirit and scope of the present invention. For example the coils can be connected to a d.c. source to provide a torque value which for a given voltage is directly proportional to speed. In this case, no tension will be applied to the yarn when the rotor is stationary. Also, in this case, a single coil or a permanent magnet could be used to produce the flux.

What is claimed is:

1. A device for applying tension to yarn, the device comprising a stator and a rotor, wherein the rotor comprises an outer spool around which, in use, yarn is passed and an inner part including a cylindrical sleeve-like portion, and wherein the stator comprises outer pole piece defining means extending between the outer spool and the sleeve-like portion of the inner rotor part, inner pole piece defining means surrounded by the sleeve-like portion of the inner rotor part and means for producing a magnetic flux between the inner and outer pole piece defining means, the rotor being formed of at least one of aluminium and an aluminium alloy.

2. A device as claimed in claim 1, wherein the magnetic flux producing means comprises at least one coil.

3. A device as claimed in claim 2, wherein the at least one coil is mounted on a core which includes a plurality of radially outwardly extending coil mounting parts equal in number to a number of said at least one coil.

4. A device as claimed in claim 3, wherein the outer pole piece defining means comprises a plurality of pole pieces equal in number to the number of said at least one coil and the outer pole pieces are connected to respective coil mounting parts of the core.

5. A device as claimed in claim 1, wherein the inner rotor part is connected at one end to the outer spool and has at another end a radially inwardly extending flange which supports an outer race of a ball or roller bearing assembly.

6. A device as claimed in claim 5, wherein the inner rotor part has at said one end a radially outwardly extending flange connected to the outer spool.

7. A device for applying tension to yarn, the device comprising a stator, a rotor and a transducer for sensing a tension in the yarn, wherein the rotor comprises an outer spool around which, in use, yarn is passed and an inner part including a cylindrical sleeve-like portion, and wherein the stator comprises outer pole piece defining means extending between the outer spool and the sleeve-like portion of the inner rotor part, inner pole piece defining means surrounded by the sleeve-like portion of the inner rotor part and means for producing a magnetic flux between the inner and outer pole piece defining means, the rotor being formed of at least one of aluminium and an aluminium alloy.

8. A device as claimed in claim 7, further comprising comparator means for comparing the tension sensed by the transducer with a reference value and for varying a current applied to the magnetic flux producing means in response to a difference between the sensed tension and the reference value to maintain a tension in the yarn equal to said reference value.

* * * * *